US008967088B2

(12) United States Patent
Lankinen

(10) Patent No.: US 8,967,088 B2
(45) Date of Patent: Mar. 3, 2015

(54) STEAM GENERATION BOILER

(75) Inventor: Pentti Lankinen, Varkaus (FI)

(73) Assignee: Foster Wheeler Energia Oy, Espoo (FI)

( * ) Notice: Subject to any disclaimer, the term of this patent is extended or adjusted under 35 U.S.C. 154(b) by 170 days.

(21) Appl. No.: 13/514,639

(22) PCT Filed: Jan. 12, 2011

(86) PCT No.: PCT/FI2011/050012

§ 371 (c)(1),
(2), (4) Date: Jul. 13, 2012

(87) PCT Pub. No.: WO2011/086233

PCT Pub. Date: Jul. 21, 2011

(65) Prior Publication Data

US 2012/0312254 A1 Dec. 13, 2012

(30) Foreign Application Priority Data

Jan. 15, 2010 (FI) ..... 20105027

(51) Int. Cl.
*F22B 31/00* (2006.01)
*F23C 10/18* (2006.01)
(Continued)

(52) U.S. Cl.
CPC ..... *F22B 29/062* (2013.01); *F22B 31/0038* (2013.01); *F23C 10/18* (2013.01); *F23M 5/08* (2013.01)
USPC ..... 122/406.4; 122/235.23; 122/367.1

(58) Field of Classification Search
CPC ..... F22B 21/00; F22B 29/06; F22B 37/04; F22B 37/143; F22B 29/062; F22B 31/0038; F23C 10/18; F23M 5/08
USPC ..... 122/406.4, 114, 470, 265, 511, 6 A, 1 B, 122/406.3, 448.4, 451 S, 451 R
See application file for complete search history.

(56) References Cited

U.S. PATENT DOCUMENTS 4,211,186 A * 7/1980 Pearce ..... 122/4 D
4,442,796 A 4/1984 Strohmeyer, Jr.
(Continued)

FOREIGN PATENT DOCUMENTS

CN 1061653 A 6/1992
EP 0 653 588 A1 5/1995
(Continued)

OTHER PUBLICATIONS

Decision on Grant issued by the Russian Patent Office on Oct. 18, 2013, in corresponding Russian Patent Application No. 2012134782/06(055723), with an English translation.
(Continued)

*Primary Examiner* — Steven B McAllister
*Assistant Examiner* — Steven Anderson, II
(74) *Attorney, Agent, or Firm* — Fitzpatrick, Cella, Harper & Scinto

(57) ABSTRACT

A steam generation boiler having a reaction chamber formed by a bottom portion in a lower portion, a roof portion at an upper portion, and walls extending vertically between the bottom portion and the roof portion. The walls include vertical end walls having a tapering wall section that tapers symmetrically with respect to its middle axis towards the bottom portion, in which (i) a first group of steam pipes in the tapering wall section including steam pipes on both sides of the middle axis, pass at an angle with respect to the middle axis in a wall plane of the tapering wall section, and from the wall plane into the reaction chamber, and (ii) a second group of steam pipes arranged to pass to the bottom portion along the wall plane.

8 Claims, 2 Drawing Sheets

(51) Int. Cl.

| | |
|---|---|
| ***F22B 29/06*** | (2006.01) |
| ***F22B 37/10*** | (2006.01) |
| ***F23M 5/08*** | (2006.01) |

(56) References Cited

U.S. PATENT DOCUMENTS

| | | | | |
|---|---|---|---|---|
| 5,168,819 | A | 12/1992 | Semedard et al. | |
| 5,570,645 | A * | 11/1996 | Garcia-Mallol | 110/245 |
| 5,775,265 | A * | 7/1998 | Brandle et al. | 122/6 A |
| 5,784,975 | A * | 7/1998 | Tanca | 110/245 |
| 6,250,257 | B1 * | 6/2001 | Kastner et al. | 122/406.4 |
| 6,263,837 | B1 * | 7/2001 | Utunen et al. | 122/4 D |
| 6,470,833 | B1 * | 10/2002 | Hyppanen | 122/4 D |
| 7,516,719 | B2 * | 4/2009 | Kral et al. | 122/6 A |
| 2002/0017100 | A1 * | 2/2002 | Berndt et al. | 60/679 |
| 2009/0084293 | A1 * | 4/2009 | Morin et al. | 110/245 |

FOREIGN PATENT DOCUMENTS

| | | | |
|---|---|---|---|
| EP | 1 607 680 | A1 | 12/2005 |
| EP | 1 953 452 | A2 | 8/2008 |
| FI | 103299 | B | 5/1999 |
| GB | 802173 | | 10/1958 |
| KR | 101378347 | A | 3/2014 |
| RU | 2040730 | C1 | 7/1995 |
| RU | 2151948 | C1 | 6/2000 |
| WO | 2005/050089 | A1 | 6/2005 |

OTHER PUBLICATIONS

Finnish Office Action dated Aug. 25, 2010, issued in counterpart Finnish Patent Application No. 20105027.

Notification of and International Search Report mailed Apr. 13, 2011, in counterpart International Patent Application No. PCT/FI2011/050012.

Written Opinion mailed Apr. 13, 2011, in counterpart International Patent Application No. PCT/FI2011/050012.

Notification mailed Jul. 26, 2012, regarding an International Preliminary Report on Patentability issued Jul. 17, 2012, in counterpart International Patent Application No. PCT/FI2011/050012.

Chinese Office Action dated Feb. 21, 2014, issued in counterpart Chinese Patent Application No. 201180006011.5, with an English translation.

* cited by examiner

STEAM GENERATION BOILER

CROSS REFERENCE TO RELATED APPLICATIONS

This application is a U.S. national stage application of PCT International Application No. PCT/FI2011/050012, filed Jan. 12, 2011, published as International Publication No. WO 2011/086233 A1, and which claims priority from Finnish patent application number 20105027, filed Jan. 15, 2010.

FIELD OF THE INVENTION

The invention relates to a steam generation boiler.

BACKGROUND OF THE INVENTION

The reaction chamber of a circulating fluidized bed once-through steam generation boiler typically comprises an inner portion that has a rectangular horizontal cross section and is defined by four sidewalls, a bottom and a roof, in which inner portion, bed material containing solids and, e.g., fuel, is fluidized by means of fluidization gas, normally, by means of oxygenous primary gas required by the exothermic reactions taking place in the reaction chamber, to be led through the bottom of the reaction chamber. The inner portion, i.e., the reactor chamber, is generally called a furnace, and the reactor is called a fluidized bed boiler, when a combustion process is performed in a circulating fluidized bed once-through steam generation boiler. Typically, the sidewalls of the furnace are also provided with pipes for supplying at least fuel and secondary air.

The sidewalls of the furnace are normally manufactured so as to comprise panels consisting of pipes and fins between them, whereby the energy released in the chemical reactions of the fuel is utilized for evaporating water flowing in the pipes. Superheating surfaces are often provided in a circulating fluidized bed once-through steam generation boiler in order to further increase the energy content in the steam.

When the aim is to manufacture a high-power boiler, e.g., a boiler with a thermal capacity of several hundred megawatts, a large reaction volume and a significant amount of evaporation and superheating surface are required. It is known from the prior art to arrange heat-exchange surfaces on the sidewalls of the boiler extending to the furnace, in order to increase the evaporation and superheating area. For instance, U.S. Pat. No. 4,442,796 discloses such heat-exchange surfaces to be arranged in a furnace. Also, published European Patent Application No. 0 653 588 B1 discloses heat-exchange walls arranged in conjunction with the sidewalls of a boiler and extending to the furnace of the boiler.

A heat exchange panel extending from a furnace wall into a furnace is known from U.S. Patent Application Publication No. 2009/0084293 A1, which panel comprises a pair of walls, in which two walls comprised of evaporation tubes face each other. Here, only one side of each wall is directly exposed to the affect of the furnace.

The area of the boiler bottom is determined on the basis of the required volume and velocity of fluidization gas directly proportional to the boiler capacity. Typically, the cross section of the reaction chamber is rectangular. Its lower portion is arranged to taper towards the grid, so that one set of sidewalls of the reaction chamber is inclined and another set of the sidewalls is straight and extends towards the grid. Here, the straight sidewalls extending towards the grid, also called the end walls in this context, taper like a wedge towards the grid, so that their edges meet the inclined sidewall sections. This applies to a reaction chamber with a rectangular cross section. Reaction chambers in a boiler with cross-sectional shapes, other than rectangles, are also known from the prior art, which reaction chambers do often, however, have such planar walls, the lower portion of which tapers towards the grid.

To arrange steam generator pipes on the wall plane in a tapering wall section is likely to become a problem, however, if the tapering is large enough. It is important for a reliable operation of a circulating fluidized bed once-through steam generation boiler that the heat exchange occurring on the steam generator surfaces in the pipes is uniform enough in the various portions of the furnace walls. This means, in practice, that it is disadvantageous for the operation of a once-through steam generation boiler if the heat delivery surfaces in the various portions of the furnace are exposed to a different impact of the fluidized bed and heat exchange, respectively, depending, e.g., on the structures of the lower portion of the grid and the furnace and on the process control. Typically, in known solutions, the lengths of the pipes in the tapering section, or at least the pipe sections remaining inside the furnace, may differ from one another in various portions of the wall.

U.S. Pat. No. 7,516,719 B2 discloses the structure of the lower section of the end walls in a once-through steam generation boiler, the purpose of which structure is to reduce the varying heat exchange of the steam generator pipes in the tapering lower section and, thus, to enable as even and comparable heat exchange as possible in each of the parallel pipes. This patent suggests reducing the pipe diameter and the fin width between the pipes in the tapering section, instead of changing the pipe length. Then, according to this patent, the various pipes are made equally long to a sufficient extent, which evens out the heat exchange to which they are exposed.

This kind of changing of the pipe size and fin width in the wall region, however, requires a plurality of welding operations, which increases the number of working phases and the risk of leakage.

SUMMARY OF THE INVENTION

One object of the invention is, thus, to provide a steam generation boiler, the structure of the lower portion of which makes it possible to provide a high-power and large-size boiler better than before.

A special object of the invention is to provide a circulating fluidized bed once-through steam generation boiler, the structure of the lower portion of which makes it possible to provide a high-power and large-size boiler better than before.

The objects of the invention are achieved by a steam generation boiler comprising a bottom portion and a roof portion, as well as walls to extend vertically between the bottom portion and the roof portion, thus forming a reaction chamber of the steam generation boiler, the walls of which reaction chamber embody a structure comprising steam generator pipes, and which steam generation boiler comprises, in its lower portion, at least one wall section tapering towards the bottom portion. The invention is mainly characterized in that a first group of steam pipes in the tapering wall section is arranged to pass from the wall plane into the reaction chamber and to extend from the wall plane to the bottom portion of the steam generation boiler on the side of the reaction chamber. Also, a second group of steam pipes is arranged to pass to the bottom portion along the wall plane.

By this kind of a solution, a steam generation boiler is provided, the structure of the end wall of which comprises steam pipes tapers towards the bottom portion, which structure is advantageous from the viewpoint of steam production.

In particular, by this kind of a solution, a once-through steam generation boiler is provided, the structure of the end wall of which comprises steam pipes tapers towards the bottom portion, thus, enabling a sufficiently uniform heat exchange to each steam pipe in the structure, which structure is advantageous from the viewpoint of the operation of the once-through steam generation boiler.

According to one embodiment of the invention, the wall section comprises a wall section that tapers symmetrically towards the bottom portion with respect to the middle axis of the wall section, in which wall section, a first group of steam pipes comprises steam pipes on both sides of the middle axis.

According to one preferred embodiment of the invention, the steam pipes of the first group pass in two different subgroups at a distance from one another, so that they essentially face one another on one side. Accordingly, one side of the first group of steam pipes included in the wall is essentially free from the heat flow of the reaction chamber, whereby their conditions essentially correspond to those of the second group of steam pipes. This is particularly advantageous in conjunction with a once-through steam generation boiler.

According to one embodiment, the different subgroups of the first group of steam pipes pass in the wall on different planes, which are located at a distance from one another, to the bottom portion of the steam generation boiler. Then, it is further advantageous that the distance between the first subgroup and the second subgroup is such that there is a space arranged between them, which space is also gas-tightly separated from the reaction chamber.

According to one embodiment, feed members for a medium are arranged in the space for feeding the medium into the reaction chamber, through the space, and/or the space is provided with one or several measuring transducers for determining the conditions prevailing in the reaction chamber. The feed members are preferably arranged so as to deliver oxygenous gas.

Preferably, the steam pipes of the first group and the second group are arranged so as to receive an essentially equal heat flow, respectively, from the reaction chamber. Then, the steam generation boiler is preferably a once-through boiler.

According to one embodiment, the steam pipes of the first group and the second group are equally long, respectively, whereby the size of the wall away from the plane of the end wall is preferably determined by the number of pipes in the first group.

According to one preferred embodiment, the first group of steam pipes extends from the plane of the end wall to the bottom portion of the steam generation boiler, on the side of the reaction chamber, passing at least a part of the way at an angle deviating from a right angle with respect to the plane, and forms a wall, the upper surface of which is inclined, in the reaction chamber.

According to one embodiment, the first and second groups of steam pipes are connected to a common distributor of the substance to be evaporated.

The steam generation boiler according to the invention is, preferably, a circulating fluidized bed once-through steam generation boiler arranged to carry out an exothermic reaction in the circulating fluidized bed maintained in its reaction chamber. The walls of the reactor of the circulating fluidized bed once-through steam generation boiler comprise steam pipes.

Then, at least the walls of the lower portion of the reaction chamber and, especially, the at least one wall section, the lower part of which tapers towards the bottom portion, and the wall formed therein, are preferably coated with refractory material on their side facing the reaction chamber.

Other additional characteristic features of the invention are disclosed in the appended claims and in the following description of the embodiments shown in the figures.

BRIEF DESCRIPTION OF THE DRAWINGS

In the following, the invention and its operation will be explained with reference to the appended schematic drawings, of which FIG. 1 schematically shows one embodiment of a circulating fluidized bed once-through steam generation boiler according to the invention.

DETAILED DESCRIPTION OF THE PREFERRED EMBODIMENTS

Figure 1:
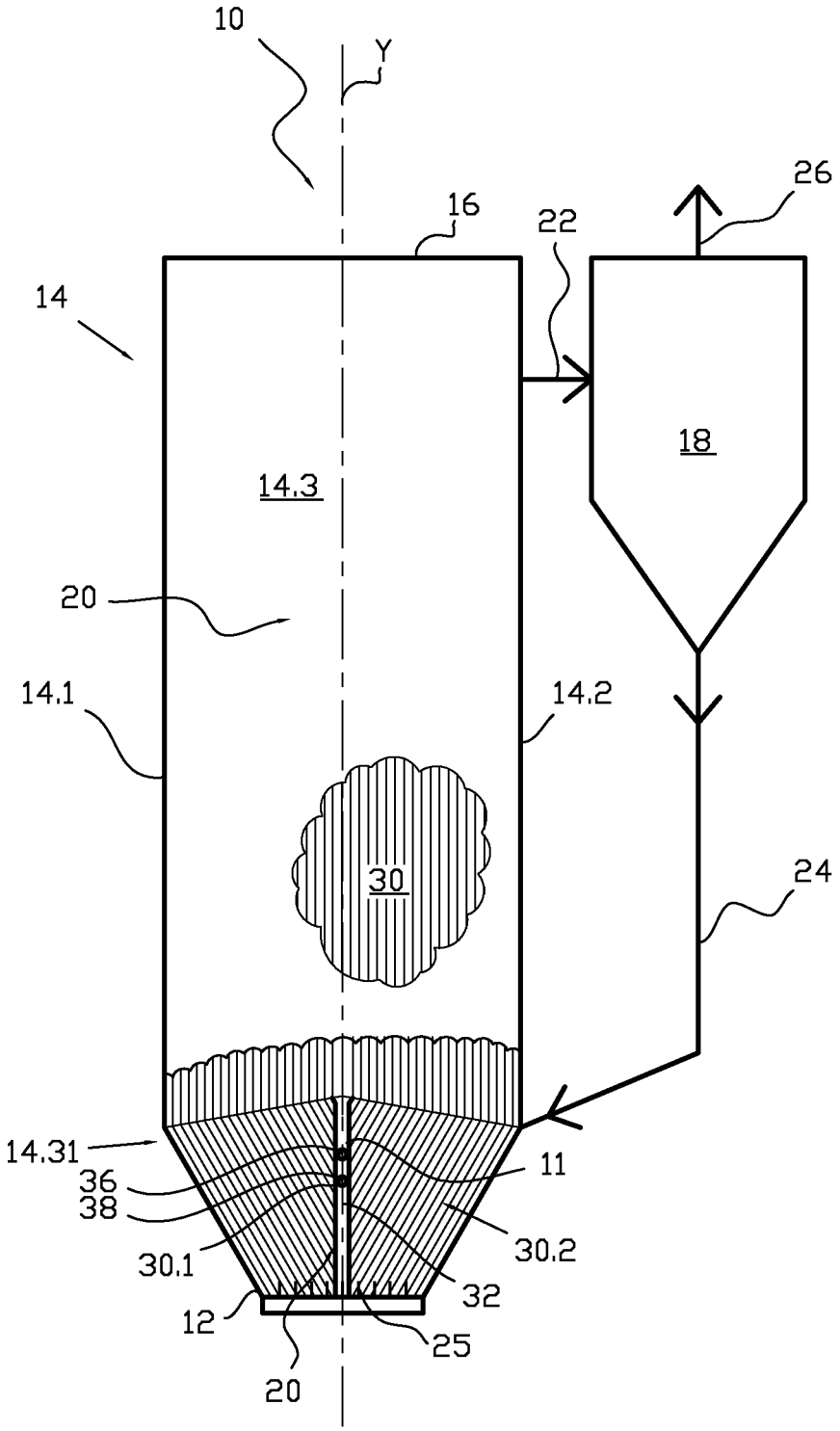

FIG. 1 schematically shows one embodiment of the steam generation boiler 10 according to the invention, the type of which boiler 10 is a circulating fluidized bed once-through steam generation boiler. The steam generation boiler 10 comprises a bottom portion 12 and a roof portion 16, and walls 14 extending between them. Further, it is obvious that a circulating fluidized bed once-through steam generation boiler comprises a number of such parts and elements that are not shown herein for the sake of clarity. The bottom portion 12, the roof portion 16, and the walls 14 form a reaction chamber 20, which, in the case of a boiler, is a furnace. The bottom portion 12 also includes a grid 25, through which, e.g., fluidization gas is led into the reactor. In addition, the fluidized bed reactor comprises a solids separator 18, which is, typically, a cyclone separator. The solids separator 18 is connected to the upper portion of the reaction chamber, in the vicinity of the roof section, by means of a connecting channel 22, through which a mixture of reaction gas and solids may flow into the solids separator 18. In the solids separator 18, solids are separated from the gas and returned into the reaction chamber 20, i.e., to the furnace, after an optional treatment, such as cooling. For this purpose, the solids separator 18 is connected to the lower part of the reaction chamber 20 by means of a return channel 24. The gas, from which solids have been separated, is led in the system to further treatment through a gas outlet 26.

Two opposite walls 14.1, 14.2 of the reaction chamber 20 are arranged so as to be inclined in the lower portion of the circulating fluidized bed once-through steam generation boiler 10, so that the sidewalls approach each other when coming closer to the bottom portion 12. Here, the reaction chamber 20 has a quadrangular cross section, whereby, it is, in addition to the sidewalls, defined by end walls, of which only one end wall 14.3 is shown herein. The lower sections 14.31 of the end walls taper when approaching the bottom portion 12. The end walls comprise steam generator pipes 30, which are preferably arranged so that the heat load from the reactor to which they are all exposed is essentially the same, respectively.

Figure 2:
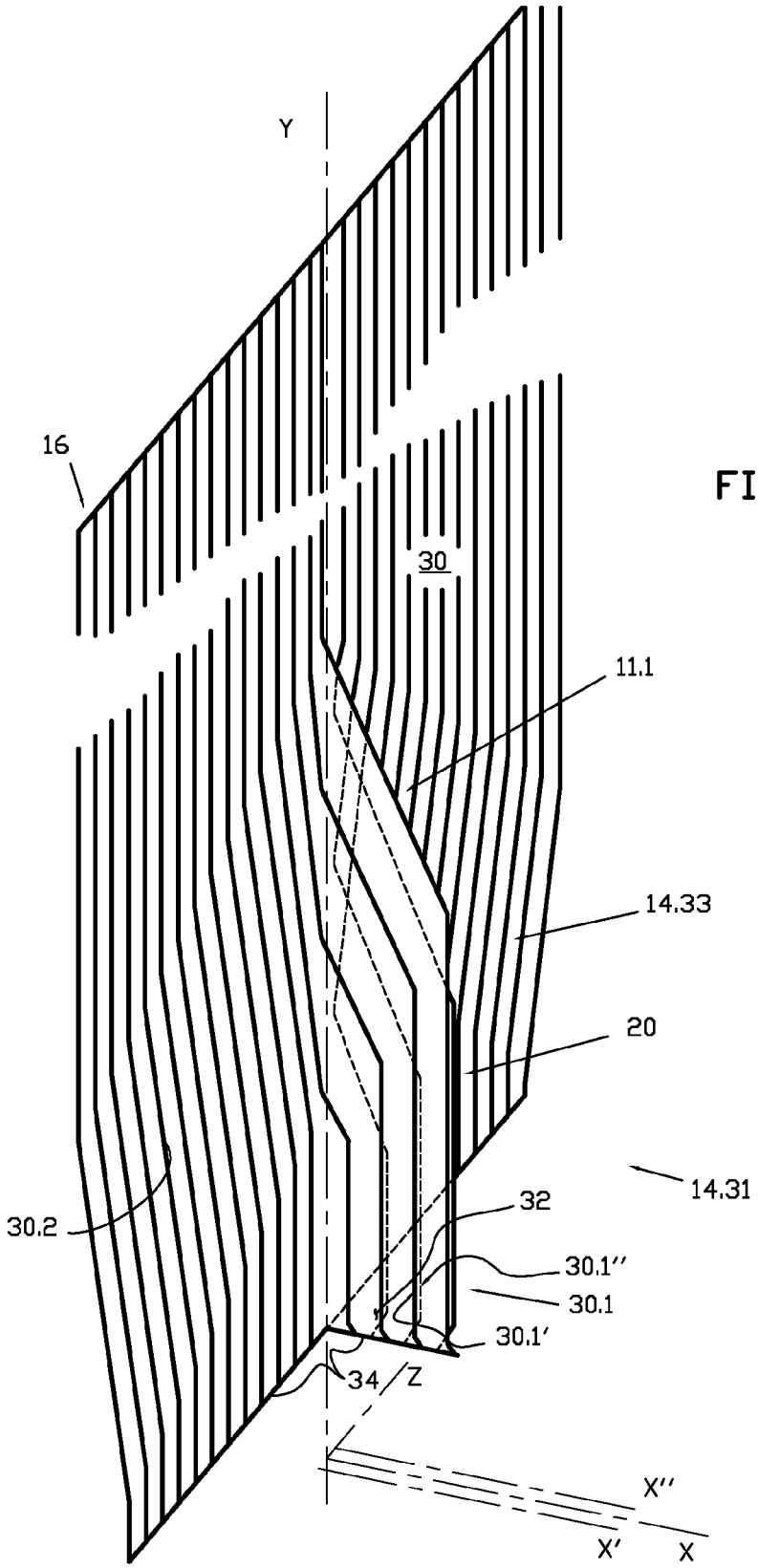
FIG. 2 shows the pipe structure of the lower section of the end wall of the circulating fluidized bed once-through steam generation boiler according to FIG. 1.

FIG. 2 schematically shows the lower section 14.31 of the end wall as for the structure of the steam generator pipes. It is to be noted that the pipes in the figure are, for the sake of simplicity, depicted by lines, and the fins that, in practice, connect the pipes, are indicated by the distances between the lines. The lower sections 14.31 of the end walls comprise a tapering section 14.33, to which the inclined section of the sidewalls is connected. The steam pipes of a first group 30.1 in the tapering wall section 14.31 are arranged so as to pass from the tapering wall section to the reaction chamber 20 and to extend from the wall plane Y-Z (FIG. 2) to the bottom portion 12 of the steam generation boiler on the side of the reaction chamber 20 forming a wall 11 in the reaction chamber 20, and the steam pipes of the second group 30.2 are arranged so as to pass the bottom portion along the wall plane Y-Z (FIG. 2). In this manner, essentially all of the steam generator pipes of the tapering section 14.33 are exposed to the reaction taking place in the reaction chamber 20. Thus, for instance, the forming of the tapering section requires neither any reduction of the pipe size, nor any essential reduction of the distance between the pipes.

Above the lower section, the end wall 14.3 is of a uniform width, essentially all the way to the roof portion 16, i.e., its width does not essentially change, whereby the number of steam generator pipes 30 and their distance from one another is more or less constant, except for any special points, such as openings. The pipes pass in the wall essentially parallel with the longitudinal axis Y of the wall. The pipes in the tapering section passing on the wall plane Y-Z are arranged so as to pass at least partially at an angle with respect to the longitudinal axis Y towards the wall 11 arranged in the tapering section 14.33 of the end wall. The steam pipes 30.1 of the first group are bent outwards from the wall plane Y-Z towards the reaction chamber 20 and further towards the bottom portion 12. The steam pipes of the second group 30.2 in the tapering section of the end wall pass on the wall plane all the way to the bottom portion 12, either the entire distance in the above-mentioned angle with respect to the longitudinal axis Y, or so that the pipes are re-bent to be parallel with the longitudinal axis Y, at the end facing the bottom portion.

In FIG. 1, the tapering wall section 14.31 is, with respect to the middle axis Y, symmetrically tapering towards the bottom portion 12. Then, the wall 11 is formed essentially in the middle of the end wall.

Each of the steam generator pipes 30.1 of the first group preferably forms an essentially, equally-long flow path, as the steam generator pipes 30.2 of the second group. In this connection, it is to be kept in mind that some minor variation may also be allowed in a once-through steam generation boiler. This has an impact on the temperature of each parallel pipe/each pipe being on the same vertical plane, and, thereby, on the stresses appearing in the pipe wall. In practice, the possible length difference is determined at the design stage according to the calculated temperature difference (for instance, the temperature of a certain pipe differing from the mean temperature) between the pipes, which temperature difference is given a specific maximum value. The maximum value is dependent, for instance, on the allowed stresses in the wall structure.

The wall 11 preferably comprises steam pipes 30.1 that are bent on both sides of the longitudinal axis Y of the wall. Further, the steam pipes 30.1 bent on both sides, i.e., the first group of steam pipes 30.1, pass in two different subgroups 30.1', 30.1" (FIG. 2) at a distance X'-X" from one another. Here, the pipes of both subgroups, and the walls formed by them, are in connection with the reaction chamber 20 on one side and lack the connection on the other side. Preferably, the first group and the second group of steam pipes face each other on one side. In practice, the first group and the second group of steam pipes form gas-tight walls or panels. Consequently, the first group of steam pipes 30.1 passing via the wall 11 is also exposed to a similar heat flow as the second group of steam pipes 30.2, which pass on the plane Y-Z of the end wall of the reactor. As discussed above, the steam generation boiler 10 according to the invention is, preferably, a circulating fluidized bed once-through steam generation boiler, whereby, the operation of the once-through boiler with a circulating fluidized bed is, due to the above-described feature, better than before.

The distance X'-X" between the pipes of the first group 30.1' and those of the second group 30.1" is, preferably, such that there is a space 32 separated from the reaction chamber 20 arranged between them. The space 32 makes it possible to arrange feed members 36 for a medium in conjunction with the wall 11, whereby the delivery of the medium via the space 32 into the reaction chamber 20 can end up to be closer to the center of the reaction chamber 20 than before. The distance X'-X" may vary within certain limits. If, in one embodiment, particularly, the distance X'-X" is longer than the diameter of two steam pipes and the width of the fin between them, the roof of the space 32 is formed of at least one of the steam pipes in the first group. When the distance is selected to be still longer, the roof may be formed of more than one parallel steam pipe.

Further, one or several measuring transducers 38 can be arranged in the space 32 for measuring the conditions prevailing in the reaction chamber 20. In this manner, measured values are received closer to the center of the reaction chamber 20, which often gives a more realistic picture of the process.

Preferably, the steam pipes 30.1 of the first group form in the wall two parallel planar structures on different planes Y-X'; Y-X" (FIG. 2). The wall is preferably vertical on the plane Y-X, whereby the abrasive affect of the solids flow in the reactor with a circulating fluidized bed is minimized.

The pipes in the wall are, preferably, joined together by means of a fin structure. In addition, the wall 11 is preferably coated with a refractory material on the surface facing the reaction chamber 20 in a manner known, per se.

The wall 11 is preferably perpendicular with respect to the plane Y-Z of the end wall 14.3 and parallel with the longitudinal axis Y of the end wall.

FIG. 2 further shows that the pipes on the upper surface of the wall are inclined. Preferably, the actual upper surface 11.1 of the coated wall is also inclined. The inclined upper surface reduces, e.g., the abrasive affect of the solids moving in the reaction chamber 20 during its operation (as a circulating fluidized bed once-through steam generation boiler). The inclined upper surface is also provided with a coating material. In the wall 11, the steam pipes of the first group 30.1 extend from the wall plane Y-Z into the reaction chamber 20 and, further, to the bottom portion 12 of the steam generation boiler passing at least a part of the way at an angle deviating from a right angle with respect to the plane Y-Z forming a wall 11, the upper surface 11.1 of which is inclined, in the reaction chamber 20.

The steam connection may be realized, for instance, so that the first 30.1 and second group 30.2 of the steam pipes are connected to a common distributor 34 for the substance to be evaporated.

It is to be noted that only a few most advantageous embodiments of the invention are described above. For instance, the cross-sectional shape of the boiler may also be other than a quadrangle. Thus, it is clear that the invention is not limited to the above-described embodiments, but may be applied in many ways. The features described in conjunction with the different embodiments may be used in conjunction with other embodiments, as well, and/or various combinations of the described features may be made within the frame of the basic idea of the invention, if so desired, and if technical feasibility for this exists.

The invention claimed is:

1. A steam generation boiler having a reaction chamber, the steam generation boiler comprising:

a bottom portion in a lower portion of the steam generation boiler;

a roof portion at an upper portion of the steam generation boiler; and walls extending vertically between the bottom portion and the roof portion, thus forming the reaction chamber of the steam generation boiler, the walls comprising vertical end walls and embodying a structure comprising steam generator pipes, the vertical end walls comprising a tapering wall section that tapers symmetrically with respect to its middle axis towards the bottom portion of the steam generation boiler, wherein (i) a first group of steam pipes in the tapering wall section, comprising steam pipes on both sides of the middle axis, is arranged to pass at an angle with respect to the middle axis in a wall plane of the tapering wall section, and from the wall plane into the reaction chamber, to extend from the wall plane to the bottom portion of the steam generation boiler on a side of the reaction chamber forming a wall in the reaction chamber, wherein the steam pipes of the first group pass from the wall plane of the tapering wall section to the bottom portion of the steam generation boiler in two different subgroups on different planes that are separated by a distance from one another, and the distance is such that the first subgroup and the second subgroup are gas-tightly separated from the reaction chamber by a space that is arranged between the first subgroup and the second subgroup, and (ii) a second group of steam pipes is arranged to pass to the bottom portion along the wall plane.

2. A steam generation boiler according to claim 1, wherein the steam pipes of the first group and the steam pipes of the second group are arranged so as to receive an essentially equal heat flow from the reaction chamber, respectively.

3. A steam generation boiler according to claim 2, wherein the steam pipes of the first group are essentially equal in length to the steam pipes of the second group.

4. A steam generation boiler according to claim 1, further comprising feed members for feeding a medium, arranged in the space, in order to feed a medium into the reaction chamber through the space.

5. A steam generation boiler according to claim 1, further comprising at least one measuring transducer, arranged in the space, for measuring the conditions prevailing in the reaction chamber.

6. A steam generation boiler according to claim 1, wherein the first group of steam pipes and the second group of steam pipes are connected to a common distributor for a substance to be evaporated in the steam generation boiler.

7. A steam generation boiler according to claim 1, wherein the first group of steam pipes extends in the reaction chamber from the wall plane to the bottom portion of the steam generation boiler, on the side of the reaction chamber, passing at least a part of the way at an angle deviating from a right angle with respect to the plane forming a wall, the upper surface of which is inclined.

8. A steam boiler according to claim 1, wherein the steam generation boiler is a circulating fluidized bed once-through steam generation boiler.

* * * * *